United States Patent [19]

Pilzer

[11] Patent Number: 4,542,827

[45] Date of Patent: Sep. 24, 1985

[54] CARPET SAMPLE SYSTEM

[75] Inventor: Daniel C. Pilzer, Atlanta, Ga.

[73] Assignee: D P Sales, Inc., Atlanta, Ga.

[21] Appl. No.: 518,125

[22] Filed: Jul. 28, 1983

[51] Int. Cl.[4] ..... B65D 75/00; B65D 85/00

[52] U.S. Cl. ..... 206/483; 206/493; 206/451; 206/44.11; 206/554; 206/806

[58] Field of Search ..... 206/483, 44.11, 480, 206/481, 493, 494, 495, 451, 452, 806, 449, 554, 486, 478; 229/68 C

[56] References Cited

U.S. PATENT DOCUMENTS

| | | | |
|---|---|---|---|
| 612,463 | 10/1898 | Steinthal | 206/493 |
| 832,585 | 10/1906 | Bodine | 206/494 |
| 858,418 | 7/1907 | Savory | 206/493 |
| 958,080 | 5/1910 | Benze | 206/495 |
| 1,131,874 | 3/1915 | Teall | 206/494 |
| 1,217,243 | 2/1917 | Tucker et al. | 206/425 |
| 1,688,101 | 10/1928 | Ackerman | 206/493 |
| 1,770,325 | 7/1930 | Shehyn | 206/477 |
| 1,785,988 | 12/1930 | Sutcliffe | 206/806 |
| 2,141,461 | 12/1938 | Cahn | 206/493 |
| 2,437,072 | 3/1948 | Campbell | 229/68 C |
| 3,514,875 | 6/1970 | Howard | 206/472 |
| 3,841,478 | 10/1974 | Wells et al. | 206/806 |
| 4,420,082 | 12/1983 | Bernie | 206/806 |

FOREIGN PATENT DOCUMENTS

| | | | |
|---|---|---|---|
| 2845526 | 4/1980 | Fed. Rep. of Germany | 206/806 |
| 602844 | 4/1926 | France | 206/44.11 |
| 7417003 | 7/1976 | Netherlands | 206/806 |
| 357642 | 9/1931 | United Kingdom | 206/451 |
| 434219 | 8/1935 | United Kingdom | 206/44.11 |
| 1008293 | 10/1965 | United Kingdom | 206/554 |

*Primary Examiner*—William T. Dixson, Jr.
*Assistant Examiner*—Brenda J. Ehrhardt
*Attorney, Agent, or Firm*—James B. Middleton

[57] ABSTRACT

A carpet sample system that provides a specification card useable alone, or in conjunction with a carpet sample, and a handle that can be used with a single carpet type or a large bundle. For knowledgeable customers, the specification card alone will provide a swatch of carpet and technical data, the cards being storable on a shelf. To display one type of carpet, a folded member will hold the card and carpet sample between the loose edges; and, a handle is provided at the opposite edge. To display several types of carpet, the folded member provides the same handle, while specification cards and carpet samples are held on each side of the handle. An index card can be provided, with a swatch of each type of carpet and appropriate legends. A backing sheet and compression block can make the large package more attractive.

5 Claims, 6 Drawing Figures

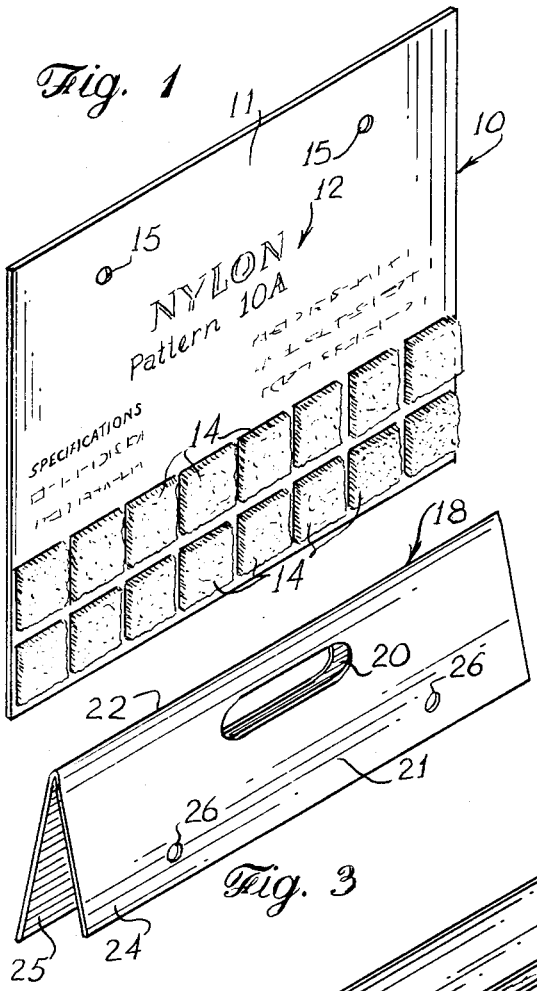
Fig. 1
Fig. 3
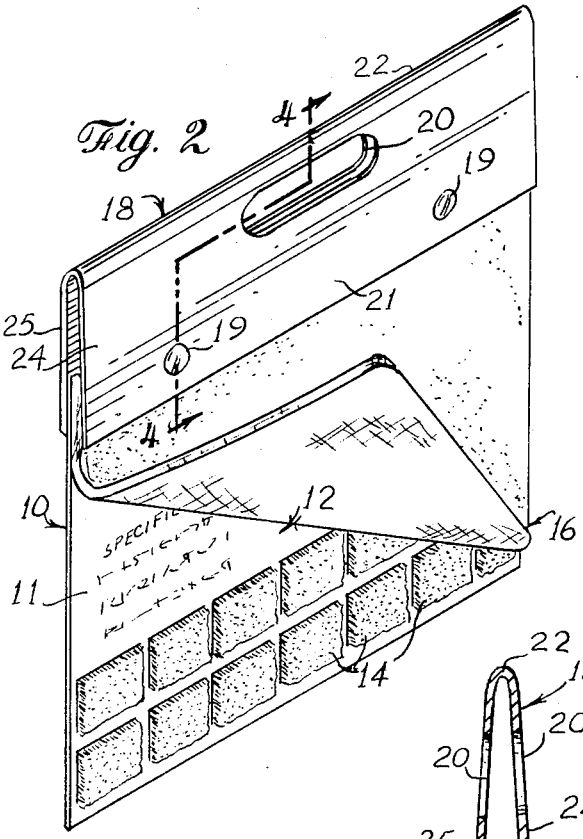
Fig. 2
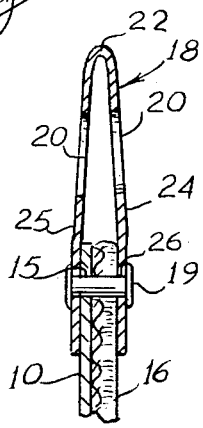
Fig. 4
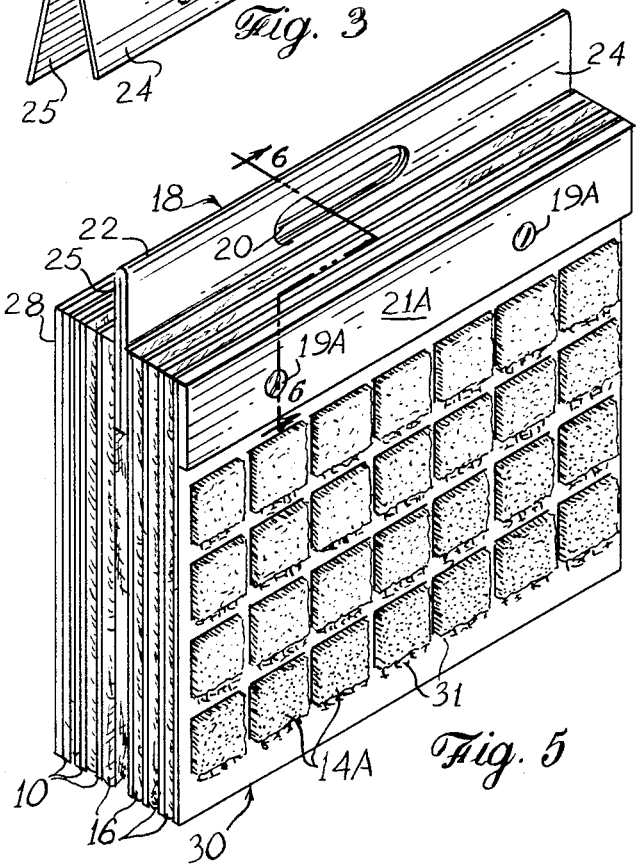
Fig. 5
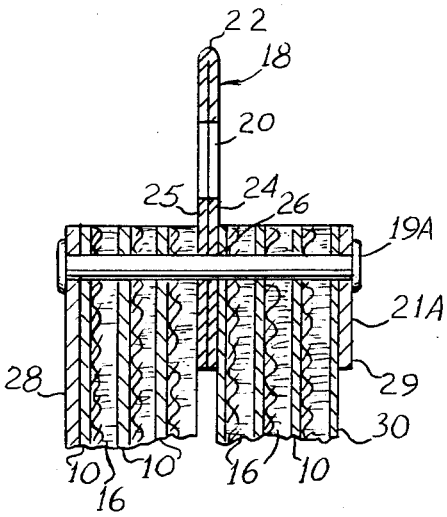
Fig. 6

CARPET SAMPLE SYSTEM

INFORMATION DISCLOSURE STATEMENT

In the sale of carpeting it is necessary to convey to the prospective customer various technical data concerning the carpeting, and it is also desirable in some cases to provide a piece of the carpeting large enough for a prospective customer to see the entire pattern, and to feel the carpet and examine both the face and the backing.

It will be understood that different types of customers will require different amounts of information. An architect, professional designer or the like may be sufficiently familiar with carpeting so that a very small swatch of the carpeting plus technical specifications will be needed. For such a person, large binders and large pieces of the carpeting will simply become a storage problem. Less sophisticated purchasers will appreciate seeing a sufficiently large sample to examine the entire piece of carpeting to see the backing and the quality of the face yarns, and to handle the carpet for general weight of the carpeting, though such a customer may still wish to see the technical specifications.

In selling carpeting, a salesman may wish to present only one type of carpeting, but to have all the information necessary on that one type of carpeting. At other times, the salesman may need to show a great variety of carpet to allow a customer to pick a pattern, kind of yarn or the like. With the conventional carpet sample systems wherein the samples and/or specifications are bound into a bulky ring binder or the like, the variation in presentation requires that one remove individual samples from the ring binder, thereby removing the finished appearance of the presentation, or the salesman must carry the entire binder to show only one sample.

There is therefore a need for a carpet sample system that allows the variation in presentation of information depending on the type of prospective customer, without requiring the carpet seller to manufacture and stock a number of entirely different sample packages and materials.

SUMMARY OF THE INVENTION

This invention relates generally to carpet sample systems, and is more particularly concerned with a versatile carpet sample system wherein a minimum number of separate pieces are combinable in various ways to achieve different carpet packages.

The present invention provides a carpet sample system including a specification card usable alone or in conjunction with a carpet sample, and handle means which includes clamping means for holding the specification card and carpet sample together. In one embodiment of the invention the handle means acts as a header with the specification card and carpet sample being bound together by the header, so a single carpet presentation is bound in one package. In another embodiment of the invention the handle means has a plurality of specification cards and carpet samples on each side thereof to allow a great quantity of carpet presentations to be held together in a single package and carried by one handle means. In the latter embodiment, an index card may be added on one side.

BRIEF DESCRIPTION OF THE DRAWINGS

These and other features and advantages of the present invention will become apparent from consideration of the following specification when taken in conjunction with the accompanying drawings in which:

FIG. 1 is a perspective view illustrating a specification card made in accordance with the present invention;

FIG. 2 is a perspective view showing a handle means binding a single specification card and a single carpet sample together;

FIG. 3 is a perspective view showing one form of handle means made in accordance with the present invention;

FIG. 4 is an enlarged cross-sectional view taken substantially along the line 4—4 in FIG. 2;

FIG. 5 is a perspective view showing a plurality of specification cards and carpet samples held together and utilizing the handle means of FIG. 3; and FIG. 6 is an enlarged cross-sectional view taken substantially along the line 6—6 in FIG. 5.

DETAILED DESCRIPTION OF THE EMBODIMENTS

Referring now more particularly to the drawings, and to those embodiments of the invention here presented by way of illustration, in FIG. 1 it will be seen that there is a generally rectangular card designated at 10, the card 10 being referred to as a specification card. It will be seen that the specification card 10 includes a front surface 11 that may be printed as generally indicated at 12, the printing including such material as the kind of fiber comprising the face yarns, the name etc. to identify the pattern, and the detailed specifications including yarn size, gauge, pile weight and height etc. It is contemplated that virtually any information that a person buying carpeting might need will be included in the printed material at 12. Obviously, if the invention is used for a single carpet mill, the printing at 12 may include the trademark or trademarks by which the carpeting is known.

The lower portion of the specification card 10 has a plurality of carpet swatches 14. It will be understood that the carpet swatches 14 will be glued or otherwise adhered to the card 10. It will also be understood, as will be discussed more fully hereinafter, that the specification card 10 will generally relate to one type of carpet, and one pattern. The various swatches 14 will then be all of the same pattern, but different colors. It will therefore be seen that, using the single specification card 10, one will have complete information about one pattern of carpeting, with an actual swatch of the carpeting to show the various colors.

Adjacent to the upper edge of the specification card 10, there is a pair of holes designated at 15, the holes 15 being provided for use with the binding means to be discussed hereinafter.

FIG. 2 of the drawings shows a specification card 10 mounted in conjunction with a carpet sample 16 to provide a single carpet presentation. It should be understood that, as used herein, the term carpet sample is intended to describe a piece of carpeting completely finished, in the form it might be sold, and large enough for a person to handle the sample and determine the weight and general quality of the carpeting. This is as distinguished from the swatch 14 which may be a very small piece of the carpeting including only the face yarns and the primary backing. These terms will be used throughout this application.

Looking further at FIG. 2 of the drawings, it will be seen that the device shown includes the specification card 10 with carpet sample 16 aligned with each other and being of generally the same external dimensions. The specification card 10 and carpet sample 16 are held together by the handle means generally indicated at 18, the handle means 18 including the binding means which, as here shown, includes a pair of binder posts 19 passing through appropriate holes. Adjacent to the upper edge of the handle means 18, there is a hole 20 which serves as a handle proper.

It will therefore be seen that the carpet sample as shown in FIG. 2 of the drawings is in the form of a header which comprises the handle means 18, the header having the carpet sample 16 and the specification card 10 depending therefrom, and held in place by the clamping means 19. The handle means 18 includes the front face area designated at 21 that can be used for various sales information such as the name of the sales company, the name of the carpet mill or the like.

For a more detailed understanding of the handle means 18, attention is directed to FIG. 3 of the drawings which shows the handle means unattached to the carpet samples. In FIG. 3 it will be seen that the handle means 18 is formed of sheet material that is scored and folded along the line 22 to provide a front panel 24 and a back panel 25. The front and back panels 24 and 25 are cut out to provide the handle 20. Also, the front and back panels 24 and 25 are appropriately drilled or punched, as at 26, to receive the binder posts 19.

With the device as shown in FIG. 3 of the drawings, it will be seen that the handle means 18 is in the general form of a hinged header or the like, and material can be placed between the front and back panels 24 and 25 so the header will hold the materials together.

The arrangement shown in FIG. 2 is more clearly illustrated in FIG. 4. Since there is only one specification card 10, and only one carpet sample 16, it will be seen that the header, or handle means 18, easily encloses the two pieces, with the binder posts 19 holding the entire assembly together. The handle 20 is sized to allow an easy grip by a normal person.

From the foregoing discussion, it should now be understood that the arrangement shown in FIGS. 2 and 4 will include one carpet presentation to display one type of carpeting. The carpet samples 16 will exhibit a relatively large piece of carpet to a prospective customer so the entire piece of carpet can be examined for quality as to both face and backing; and, the pattern is presented in a sufficiently large portion that the prospective customer can visualize the carpeting as it may look when installed. In conjunction with this carpet sample 16, the specification card 10 is provided with the plurality of swatches 14. As a result, the prospective customer can determine the overall quality of the carpet from the sample 16, then can pick a color from the swatches 14. Of course the printed material at 12 will provide the detailed specifications. All this information is arranged in an attractive package that is easy for a salesman to carry and present to a prospective customer, and is easy for the customer to examine.

Looking next at FIG. 5 of the drawings, it will be seen that a large quantity of carpeting is presented. It should first be recognized that the handle means 18 is again utilized to provide the handle 20 and to support the clamping means.

Specifically, and with attention also to FIG. 6 of the drawings, it will be seen that the device as here presented includes a backing sheet 28 that may be a relatively stiff material simply to provide a higher quality appearance to the entire package. Opposite the backing sheet 28, there is a compression block 29 which may be of a material similar to that of the backing sheet 28. It will be noted that the compression block 29 covers only the top portion of the package, and this will be discussed in more detail later.

Between the backing sheet 28 and the compression block 29, it will be seen that there is a plurality of carpet presentations, a presentation including the specification card 10 in conjunction with a carpet sample 16. The plurality of carpet presentations is divided substantially equally, and half placed on each side of the handle means 18. The binder posts, here designated as 19A, pass through each of the carpet presentations, and through the holes 26 in the handle means 19, to hold the entire device together.

The front sheet, or card, in the device shown in FIGS. 5 and 6 is an index card 30. Looking especially at FIG. 5 of the drawings, it will be seen that the index card 30 includes a plurality of swatches such as the swatches 14, these swatches being designated at 14A. Adjacent to each of the swatches 14A, there is a printed legend 31 or the like.

It should now be understood that the carpet sample system as shown in FIGS. 5 and 6 comprises a large grouping of carpet presentations so a salesman can show a prospective customer a large variety of carpeting to allow the customer to select the desired carpeting. For the information of the salesman, the swatches 14A with the legends 31 will indicate the various carpets that are in the particular grouping. It will of course be understood by those skilled in the art that the legend 31 may indicate the brands of carpet, the type of fiber used for face yarns, the various patterns or the like. The particular grouping can be made on any basis desired, and the index card 30 should provide an appropriate index on the same basis.

Since, in the arrangement shown in FIGS. 5 and 6 of the drawings, the front face area 21 of the handle means 18 is covered by the carpet presentations, the compression block 29 can be similarly used, the compression block 29 having the front face area 21A that can be used for an identifying logo or the like.

From the foregoing description, the use of the present invention should be understandable. For architects, professional designers and the like who are highly knowledgeable about carpeting, the specification card 10 may be used alone. Such a person will ususally be so knowledgeable about patterns that the small swatch 14 will be sufficient, the primary selection being made on the basis of the colors and the techinal information provided in the printed material 12. Since the specification card 10 will generally be formed of a card stock stiff enough to stand alone, a plurality of specifications cards 10 can be placed on a book shelf or the like so minimum storage space will be required.

When a salesman needs to show one type of carpeting, the arrangement shown in FIGS. 2 and 4 can be used. The carpet sample 16 provides information necessary for naive purchasers, but th specification card 10 still provides all the information that may be necessary, and to allow the salesman to point out features to the customer. The handle means 18 provides an attractive header and a convenient carrying means to show the particular type of carpeting.

When a large number of samples need to be shown to customers, the arrangement shown in FIGS. 5 and 6 may be used, this arrangement being, generally, a multiplication of the device shown in FIGS. 2 and 4.

It will be understood that the specification card 10 is used in the device of FIG. 1, the device of FIGS. 2 and 4, and in the device of FIGS. 5 and 6, so one group of specification cards 10 can be made up and utilized in any manner desired.

It will also be understood that the handle means 18 as shown in FIG. 3 of the drawings is precisely the same as the handle means 18 shown in FIGS. 2 through 6. In FIGS. 2 and 4, the handle means 18 is slightly spread apart with the specification card 10 and carpet sample 16 between the front and rear panels 24 and 25, while the device shown in FIGS. 5 and 6 utilizes the handle means 18 flattened with the carpet presentations placed on each side of the handle means 18. The index card 30 may be added if desired. Since binder posts or other releasable fastening means are used, a salesman can convert one of the large groups of sample systems of FIGS. 5 and 6 into a plurality of the single presentation packages shown in FIG. 2 by simply dividing up the carpet presentations and placing a handle means 18 on each carpet presentation. Conversely, a plurality of the single presentation packages as shown in FIG. 2 can be placed together with one of the handle means 18 to provide large package of presentations as shown in FIG. 5.

It will therefore be seen that the carpet sample system of the present invention is an extremely versatile system utilizing a minimum number of different pieces that can be combined and put together in different ways to achieve different sales packages.

It will of course be understood by those skilled in the art that the particular embodiments of the invention here presented are by way of illustration only, and are meant to be in no way restrictive; therefore, numerous changes and modifications may be made, and the full use of equivalents resorted to, without departing from spirit or scope of the invention as defined in the appended claims.

I claim:

1. A carpet sample package including at least one specification card, at least one carpet sample, and one handle means for carrying said sample package, said specification card being formed of sheet material sufficiently stiff to stand on its edge and including printed material for indicating technical data for a carpet type, a plurality of swatches of said carpet type carried by said specification card, each swatch of said plurality of swatches having a different characteristic while being of said carpet type, said specification card defining holes therein adjacent to the upper edge of said specification card, said handle means including binding means selectively cooperating with said holes in said specification card for carrying said specification card on said handle means, said carpet sample being substantially the same size as said specification card and defining holes therein, said holes in said carpet sample being aligned with said holes in said specification card when said carpet sample is aligned with said specification card and selectively cooperating with said binding means, said carpet sample being of said carpet type, said handle means including a front panel, and a back panel coextensive with said front panel, said front panel and said back panel being hinged to each other along a line, said front panel and said back panel defining openings therethrough of such size as to receive a person's fingers for holding said sample package so that said openings constitute a handle proper, said front panel and said back panel defining holes therein selectively alignable with said holes in said specification card and in said carpet sample, said binding means being receivable through the aligned holes, the arrangement being such that said carpet sample and said specification card can be received between said front panel and said back panel of said handle means, and a plurality of said carpet samples and specification cards can be received on opposite sides of said handle means with said front panel and said back panel held together with said binding means.

2. A carpet sample package for carrying at least one carpet presentation, said carpet presentation comprising a specification card including data for a carpet type and a plurality of swatches of carpet of said carpet type, each swatch of said plurality of swatches having a different characteristic, and a carpet sample of said carpet type, said sample package including handle means, clamping means carried by said handle means for selectively carrying said at least one carpet presentation, said handle means defining a handle proper engageable by a person's hand and including a front panel and a back panel hinged together along an upper edge so that the opposite edges are selectively separable, said clamping means being located adjacent to said opposite edge, said at least one carpet presentation being selectively receivable between said front and back panel with said opposite edges separated for receiving said at least one carpet presentation therebetween, and receivable against one panel of said front and back panels with said opposite edges together, said at least one carpet presentation being held by said clamping means, said at least one carpet presentation comprising a plurality of carpet presentations, approximately half said plurality of carpet presentations being located to the rear of said handle means, and approximately half said carpet presentations being located to the front of said handle means, said clamping means holding all of said plurality of carpet presentations.

3. A carpet sample package as claimed in claim 2, and further including an index card, said index card including a swatch of each carpet type of said plurality of carpet presentations, said index card being of the same size as said specification card and held by said clamping means.

4. A carpet sample package as claimed in claim 3, and further including a backing sheet for said sample package located at the back of said plurality of carpet presentations, and a compression block located at the front of said plurality of carpet presentations, said clamping means holding said compression block.

5. A carpet sample package as claimed in claim 4, said handle proper comprising aligned openings through said front panel and said back panel of such size as to receive a person's fingers.

* * * * *